US006439269B1

(12) United States Patent
Weil et al.

(10) Patent No.: US 6,439,269 B1
(45) Date of Patent: Aug. 27, 2002

(54) ROOM DARKENER FABRIC WITH SOLUTION DYED BLACK YARN

(75) Inventors: Albert J. Weil, Southport, NC (US); Edward G Hare, Forest, VA (US); E. Keith Adams, Asheboro; Keith D Blough, Oak Ridge, both of NC (US)

(73) Assignee: Burlington Industries, Inc., Greensboro, NC (US)

( * ) Notice: Subject to any disclaimer, the term of this patent is extended or adjusted under 35 U.S.C. 154(b) by 0 days.

(21) Appl. No.: 09/892,903

(22) Filed: Jun. 28, 2001

Related U.S. Application Data

(60) Provisional application No. 60/214,386, filed on Jun. 28, 2000.

(51) Int. Cl.[7] ..... D03D 15/00

(52) U.S. Cl. ..... 139/383 R; 139/420 A; 28/151

(58) Field of Search ..... 139/383 R, 420 A; 28/151

(56) References Cited

U.S. PATENT DOCUMENTS

| | | | | |
|---|---|---|---|---|
| 4,677,016 A | | 6/1987 | Ferziger et al. | |
| 5,019,445 A | | 5/1991 | Sternlieb | |
| 5,360,668 A | | 11/1994 | Sternlieb | |
| 5,865,219 A | * | 2/1999 | Lee et al. | 139/383 A |
| 6,223,780 B1 | * | 5/2001 | Kaldenhoff | 139/383 A |

FOREIGN PATENT DOCUMENTS

| | | |
|---|---|---|
| GB | 2 222 801 A | 3/1990 |
| JP | 7 8045-428 | 5/1974 |
| JP | 6 1225-347 A | 3/1985 |
| JP | 6 3059-475 A | 8/1986 |
| JP | 6 3099-375 A | 10/1986 |
| JP | 6 3235-573 A | 3/1987 |
| JP | 0 3124-841 A | 10/1989 |
| JP | 04369536 A | 4/1991 |
| JP | 06065854 A | 8/1992 |

* cited by examiner

*Primary Examiner*—Andy Falik
(74) *Attorney, Agent, or Firm*—Nixon & Vanderhye

(57) ABSTRACT

A room darkener fabric has about 40–60% of flame-resistant warp yarns on a face and 60-40% on the back. The warp yarns produce a fire-resistant barrier for a middle layer of non-flame resistant black yarn. About 70–90% of the black filling yarns binds with the warp yarns and forms a middle layer so that both the face and back comprise approximately 85–95% white warp yarns and 5–15% black filling yarn, with the balance of the black filling yarns forming the middle layer. The filling yarn is a non-flame resistant yarn that is solution dyed black.

10 Claims, 4 Drawing Sheets

1 Repeat 10 Ends 2 Dents

Weave

| | | | | | | | | | |
|---|---|---|---|---|---|---|---|---|---|
| 10 | | 8 | | 6 | | 4 | | 2 | |
| | 9 | | 7 | | 5 | | 3 | | 1 |
| | | X | | | X | X | X | X | |
| | | | | X | X | | X | X | X |
| | X | | | | X | X | X | | X |
| | | | X | | | X | X | X | X |
| X | | | | | X | X | | X | X |
| | | X | | | X | X | X | X | |
| | | | | X | X | | X | X | X |
| | X | | | | X | X | X | | X |
| | | | X | | | X | X | X | X |
| X | | | | | X | X | | X | X |

10px

Fig. 2

ROOM DARKENER FABRIC WITH SOLUTION DYED BLACK YARN

RELATED APPLICATIONS

This application is a continuation of provisional application Ser. No. 60/214,386, filed Jun. 28, 2000.

BACKGROUND AND SUMMARY OF THE INVENTION

In the mid-1990s a product was developed that was a significant advance over the existing technology for room darkener fabrics. Using a system of inherently flame resistant yarns, a fabric was woven which had three layers of fiber, each layer interlaced between warp and filling, incorporating a natural warp with a black filling. The black filling was package dyed yarn. The weave used produced a fabric that has about half the warp yarn weaving on the face and about half the warp yarn weaving on the back, with about 80% of the black filling in the middle layer, bound with the warp yarns. The final fabric has a face and back each made up of approximately 90% white yarn and 10% black filling yarn with the balance of the black filling yarn forming the middle layer. The fabric uses flame resistant yarns throughout and is capable of passing the necessary fire tests, namely those provided by fire code NFPA-701-96.

While the prior art fabric described above has been very successful, it does have several drawbacks. The first is that while it does have excellent room darkening properties, there are still many circumstances where well over 2% of the visible light is transmitted. Thus while the light level that it provides is low, it may not be completely dark in a room using the fabric as a room darkener should there be a number of windows with the sun shining directly on the windows. Also the fabric can only be produced in prepared-for-print form (that is scoured and heat set) because the black dye bleeds during the high temperature used in dyeing, and contaminates the color of the white warp yarn.

According to the present invention, by making in hindsight minor modifications to the prior art fabric, its performance has been enhanced dramatically, and its versatility has been enhanced, while its cost is decreased.

According to the present invention, a fabric is produced that is substantially the same as the prior art fabric except that instead of using all flame resistant yarns, the filling yarn is non-flame resistant yarn that is solution dyed black. Despite the fact that the filling yarns are non-flame resistant because of the fabric construction it passes fire code NFPA-701-96, which is necessary for it to be appropriately used as a room darkener fabric in the hospitality and health care market.

By making a simple, in hindsight, change in the type of filling yarn used, and solution dyeing the filling yarn, dramatic advantages have been achieved. The first functional advantage is that the fabric according to the invention is much more opaque than the prior art fabric. The fabric according to the present invention transmits less than 2% of the visible light, and less than 2% of the infrared light, in all circumstances for which it has been tested, and most of the time less than 1 % of the light; that means it blocks at least 98% of the light, and typically more than 99% of the light. In tests comparing the fabric according to the invention with the prior art fabric, under exactly the same circumstances, the amount of visible light transmitted using the prior art fabric ranged from 1.95% to 7.23%, whereas for the fabric according to the invention the amount of visible light transmitted ranged between 0.46% and 1.27%, in some circumstances literally making a perceived difference of between "night" and "day".

Also the fabric according to the invention can be produced in prepared-for-print form where it is scoured and heat set and also in dyed form, dyeing the white warp yarns without the bleeding or running of the black filling yarns during the high temperature used in the dyeing process. This can provide much more aesthetic and versatile fabrics.

Further, despite the fact that a non-flame resistant polyester filling yarn is utilized (which yarn is usually less expensive and more versatile than comparable flame resistant yarns) the fabric still obtains results that have passed NFPA-701-96. Thus without commercially significant change in the flame resistance properties a much more functional and versatile fabric is produced according to the invention.

The following table indicates the results of comparative testing between the fabric according to the present invention with non-flame resistant solution dyed black polyester filling yarns, and the fabric of the prior art which is the same as the fabric of the invention only with flame resistant packaged dyed polyester filling yarns. In the table the fabric according to the invention has code number 3187, and the prior art fabric has code number 37095.

TABLE I

| Construction | TESTS (% of light transmitted) | | |
|---|---|---|---|
| Fabric #3187 | B3187A.DAT | B3187B.DAT | B3187C.DAT |
| Average (250–800 nm) | .069% | 0.85% | 0.95% |
| Average (400–800 nm) | .093% | 1.13% | 1.27% |
| Average (400–700 nm) | 0.46% | 0.55% | 0.64% |
| Fabric #37095 | B37095A.DAT | B37095B.DAT | B37095C.DAT |
| Average (250–800 nm) | 5.13% | 5.09% | 5.33% |
| Average (400–800 nm) | 6.99% | 6.94% | 7.23% |
| Average (400–700 nm) | 1.95% | 2.08% | 2.30% |

Thus, the fabric according to the present invention blocks at least 98%, and typically more than 99%, of the visible and infrared light waves; a decrease of about 300–500% in the amount of light transmitted compared to the prior art.

BRIEF DESCRIPTION OF THE DRAWING FIGURES

FIG. 2 is a schematic illustration of the weave chain for the fabric.

Thus, according to the present invention a room darkener fabric is provided having about 40–60% (preferably about 50%) of flame resistant warp yarns on the face and 60–40% (preferably about 50%) on the back. The warp yarns produce a fire resistant barrier for a middle layer of non-flame resistant black yarn. Typically about 70–90% (e.g. about 80%) of the black filling yarn binds with the warp yarns and forms the middle layer, so that both the face and back are made up of approximately 85-95% (e.g. about 90%) white warp yarns and 5–15% (e.g. about 10%) black filling yarn with the balance of the black filling yarns forming the middle layer. The following provides one example of an exemplary specific construction according to the present invention. While exemplary supplier names are given in this example it is to be understood that substantially equivalent products from other manufacturers can be substituted:

Warp Yarn—1/150/60 Avora FR, False twist textured, Kosa feed yarn. Could range in filament count from about 32 to 70. Could be Kosa FR yarn or similar performing FR yarn.

Filling Yarn—1/150/34 Solution dyed Black T 56B (DuPont) Polyester (not FR) false twist textured/set, Dacron feed yarn. Could range from about 32 filament to 100 filament.

While a wide variety of fabric weights may be produced, a typical weight is between about 7–9 (e.g. about 8) ounces per square yard.

Figure 1:
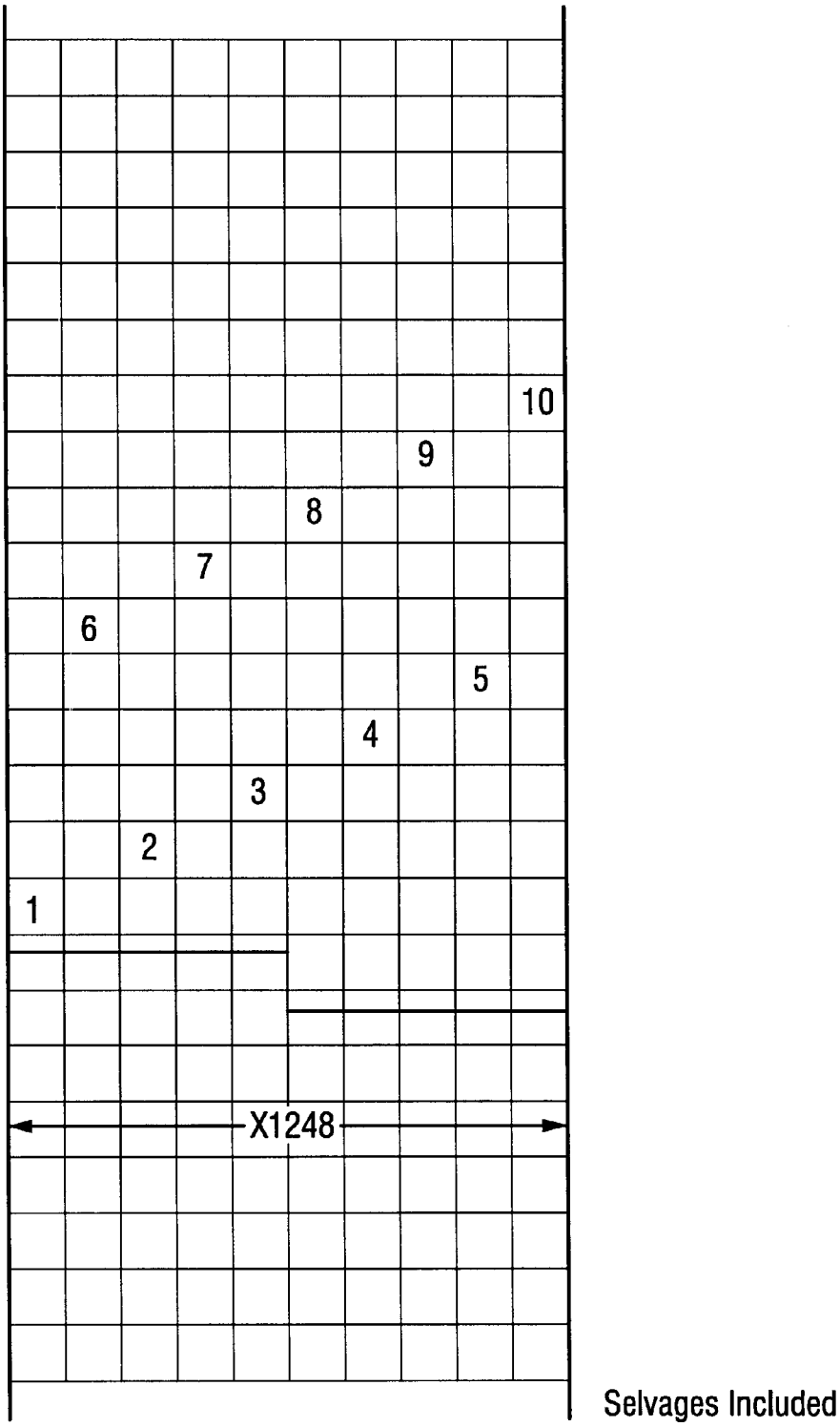
FIG. 1 is a schematic illustration of a weaving draw in the fabric according to the present invention.

The construction of the fabric of the invention is unique. FIG. 1 is an exemplary weaving draw in the fabric according to the invention, while FIG. 2 is an exemplary weave chain. The draw represents how the warp ends are entered onto the harnesses. The harnesses lift the ends to form the weave pattern. Which harnesses are lifting is in turn controlled by the weave chain.

Figure 3:
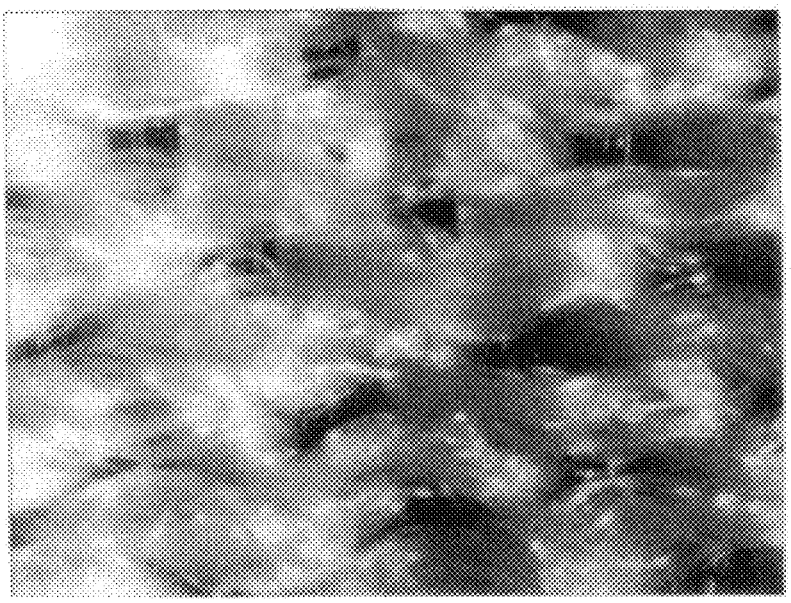
FIGS. 3 and 4 are electron microscope photographs of the face and back of a fabric according to the present invention.
Figure 4:
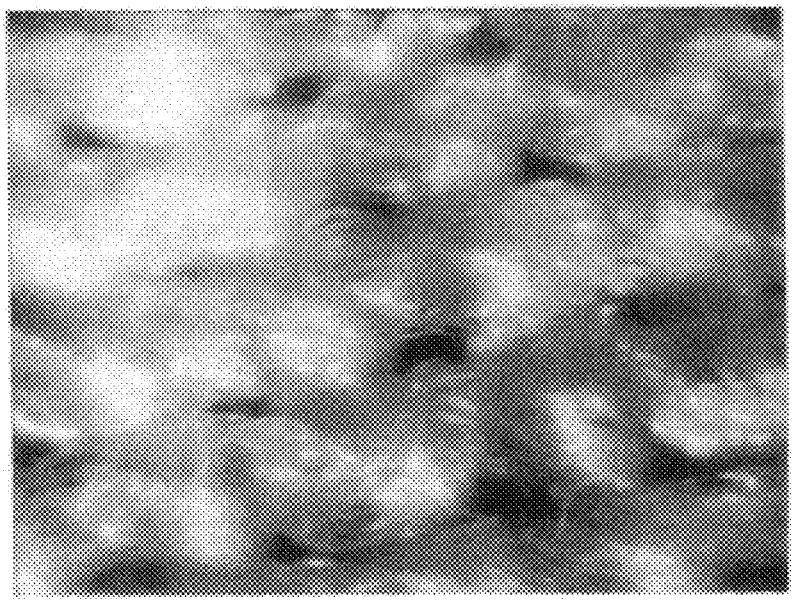

FIGS. 3 and 4 are electron microscope photos of the face and back, respectively, of an exemplary fabric according to the invention. The photo of FIG. 3 shows the white warp and small areas of black filling between the warp yarns. The same is true of FIG. 4. In the embodiment illustrated FIGS. 3 and 4 are almost the same because about 50% of the warp is on each side of the fabric with the filling in the center.

Figure 5:
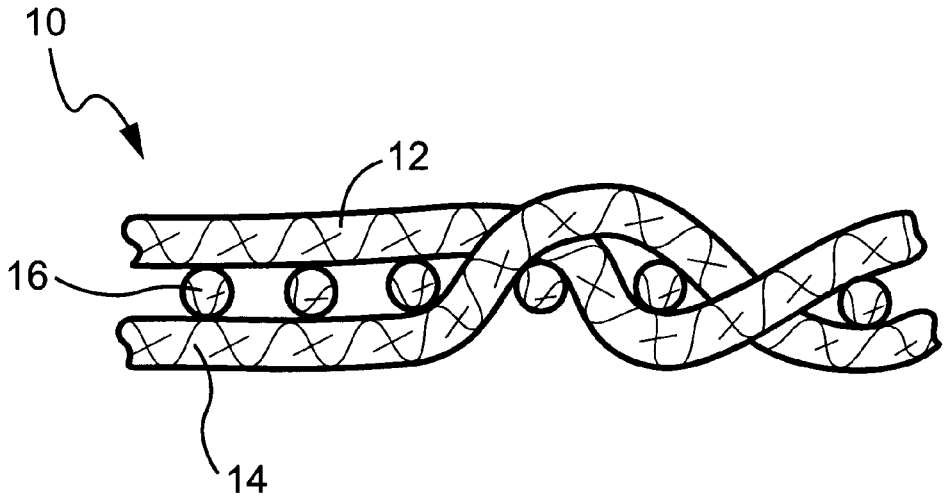
FIG. 5 is an enlarged schematic cross-sectional view of a fabric according to the present invention.

Referring to FIG. 5, there is illustrated a room darkener fabric, generally designated 10, having a weave of three layers of yarns 12, 14 and 16, with each layer being interlaced between warp and filling yarns. The warp yarns are identified at 12 and 14 and the filling yarns at 16.

The finished count may vary widely. For example it may be about 200–250 ends by about 70–90 picks (e.g. about 225 by 79).

Thus, the invention provides a room darkener fabric having flame resistant warp yarns woven so that roughly half of the natural warp yarns are on the face and roughly half are on the back with about 80% of black filling non-flame resistant yarns that are solution dyed forming a middle layer between the face and the back and bound with the warp yarns, a method of manufacture thereof, and a room darkener so produced.

In all of the ranges given above the invention also specifically contemplates each narrow range within a broad range. Also, the invention is to be interpreted as broadly as allowed by the prior art.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A room darkener fabric comprising:

a woven fabric having three layers of yarns with each layer interlaced between warp and filling yarns;

said warp yarns being white and flame resistant and having about 40–60% of said warp yarns on a face of the fabric and about 60–40% warp yarns on a back of the fabric;

said filling yarns being non-flame resistant black yarns;

about 70–90% of said black filling yarns binding with the warp yarns and forming a middle layer such that the face and back include about 85–95% white warp yarns and about 5–15% black filling yarn with the balance of the black filling yarns forming a middle layer whereby substantially less than 2% of visible light is transmitted through the fabric.

2. A fabric according to claim 1, wherein said non-flame resistant filling yarns are solution dyed black.

3. A fabric according to claim 1, wherein about 50% each of the white warped yarns lie on the face and back respectively.

4. A fabric according to claim 1, wherein about 80% of the black filling yarns binds with the warp yarns to form the middle layer such that both the face and back comprise about 90% of the white warp yarns and about 10% of the black filling yarns.

5. A fabric according to claim 1, wherein about 50% each of the white warp yarns lie on the face and back respectively, and wherein about 80% of the black filling yarns binds with the warp yarns to form the middle layer such that both the face and back comprise about 90% of the white warp yarns and about 10% of the black filling yarns.

6. A fabric according to claim 5, wherein said non-flame resistant filling yarns are solution dyed black.

7. A room darkener fabric comprising:

a woven fabric having three layers of yarns with each layer interlaced between warp and filling yarns;

said warp yarns being white and flame resistant and having about 40–60% of said warp yarns on a face and about 60–40% warp yarns on a back of the fabric;

said filling yarns being solution-dyed black yarns;

about 70–90% of said black filling yarns binding with the warp yarns and forming a middle layer such that the face and back include about 85–95% white warp yarns and about 5–15% black filling yarn with the balance of the black filling yarns forming a middle layer whereby substantially less than 2% of visible light is transmitted through the fabric.

8. A fabric according to claim 7, wherein about 50% each of the white warp yarns lie on the face and back respectively.

9. A fabric according to claim 7, wherein about 80% of the black filling yarns binds with the warp yarns to form the middle layer such that both the face and back comprise about 90% of the white warp yarns and about 10% of the black filling yarns.

10. A fabric according to claim 7, wherein about 50% each of the white warp yarns lie on the face and back respectively, and wherein about 80% of the black filling yarns binds with the warp yarns to form the middle layer such that both the face and back comprise about 90% of the white warp yarns and about 10% of the black filling yarns.

* * * * *

UNITED STATES PATENT AND TRADEMARK OFFICE

CERTIFICATE OF CORRECTION

PATENT NO. : 6,439,269 B1
DATED : August 27, 2002
INVENTOR(S) : Weil et al.

It is certified that error appears in the above-identified patent and that said Letters Patent is hereby corrected as shown below:

Column 3,
Line 3, change “Avora FR” to -- KoSa FR. --

Signed and Sealed this

Sixteenth Day of September, 2003

JAMES E. ROGAN
*Director of the United States Patent and Trademark Office*